United States Patent [19]

Focke

[11] 4,179,864

[45] Dec. 25, 1979

[54] APPARATUS FOR SETTING AND SHAPING GLUED CIGARETTE PACKS

[75] Inventor: Heinz Focke, Verden, Fed. Rep. of Germany

[73] Assignee: Focke & Pfuhl, Verden, Fed. Rep. of Germany

[21] Appl. No.: 904,362

[22] Filed: May 9, 1978

Related U.S. Application Data

[63] Continuation-in-part of Ser. No. 816,068, Jul. 15, 1977, abandoned.

[30] Foreign Application Priority Data

Jul. 22, 1976 [DE] Fed. Rep. of Germany ..... 2632968

[51] Int. Cl.[2] ..... B65B 51/14

[52] U.S. Cl. ..... 53/388; 53/234

[58] Field of Search ..... 53/388, 387, 234, 148; 198/480, 484, 653, 655

[56] References Cited

U.S. PATENT DOCUMENTS

| | | | |
|---|---|---|---|
| 609,472 | 8/1898 | Symser | 53/387 |
| 1,827,618 | 10/1931 | Sauerbeck | 53/388 |
| 3,236,026 | 2/1966 | Evans | 53/387 |
| 3,988,876 | 11/1976 | Seragnoli | 53/388 X |

*Primary Examiner*—Travis S. McGehee

*Attorney, Agent, or Firm*—Sughrue, Rothwell, Mion, Zinn and Macpeak

[57] ABSTRACT

A device for profiling and shaping cuboid-shaped packages having blank parts fastened by gluing. Shaping chambers are disposed on a heated turret to enclose the packs until the glue sets. The shaping chambers have dimensions nearly corresponding to the desired shape of the packages. A wedge-shaped member is used with the shaping chambers to define profiling surfaces for delimiting the chamber. The turret is heated by circular heating bands located on opposite annular sides of the shaping chambers.

10 Claims, 4 Drawing Figures

APPARATUS FOR SETTING AND SHAPING GLUED CIGARETTE PACKS

CROSS-REFERENCE TO RELATED APPLICATION

This application is a continuation-in-part of now abandoned Ser. No. 816,068, filed on July 15, 1977 and entitled, "A Process and Apparatus for Shaping or Improving the Shape of Oblong Packs."

BACKGROUND OF THE INVENTION

1. Field of the Invention

The present invention relates to apparatus for shaping and improving the shape of oblong packs, more particularly, cigarette packs, the blank parts of which (flaps, tabs, etc.) are connected together by means of an adhesive.

2. Description of the Prior Art

Oblong cigarette packs are generally produced from paper or cardboard blanks. In this process individual flaps, tabs and other parts of the blank are folded and joined together in such a way that the packs obtain an oblong shape.

As the folding operations in the production of these packs are completed extremely rapidly, the finished packs generally do not have the desired precise oblong shape. This invention is concerned with shaping the packs following the application of the adhesive to give the desired final configuration.

SUMMARY OF THE INVENTION

The object of the present invention is to provide an apparatus for shaping or improving the shape of oblong packs.

The apparatus according to the invention is designed to solve this problem wherein folded packs are retained in a shaping chamber conforming to the ideal form of the packs and enclosing the packs on all sides or virtually on all sides, without relative displacement with respect to the chamber, until setting (hardening) of the glue. The shaping or molding chamber according to the invention is heated and possesses the exact and thus desired dimensions of the oblong packs. The pack is retained in this chamber until the glue is dry while simultaneously adapting the finished pack to the dimensions and shape of the chamber.

The apparatus uses two annular heating rings disposed on a rotating turret that provides localized heating of the shaping chamber. The heating chambers are encircled by the heating rings and the annular ring is thermally isolated from the rest of the turret. The heating temperatures in the chambers are kept below the plastification temperature of the glue or the packaging material but are sufficiently high to provide an increased rate of hardening over an unheated pack.

The apparatus according to the invention preferably comprises a rotating turret having on its periphery a plurality of closely spaced adjacent shaping chambers each designed to temporarily receive a pack. The packs are inserted in succession in the shaping chambers of this turret. They remain in the shaping chambers for a complete or essentially complete rotation of the turret while being heated to accelerate hardening of the glue. Accordingly, even with high operating rates of the packaging machine, the large number of chambers ensures that sufficient shaping time is available.

Other features of the invention relate to the construction of the shaping chambers and to the heating of the turret.

Other objects, features and advantages of the present invention will be made apparent in the course of the following description thereof which is provided with reference to the accompanying drawings.

DETAILED DESCRIPTION OF THE PREFERRED EMBODIMENT

The embodiment represented relates to the processing of cigarette packs 10 and, more particularly, of so-called hard box packs. These packs 10 have already been produced in a plurality of folding steps and have been filled. In this process, flaps, tabs, etc., of the pack blank are connected together in a conventional manner by means of glue spots. A specific period of time is generally required for the glue to harden.

Figure 1:
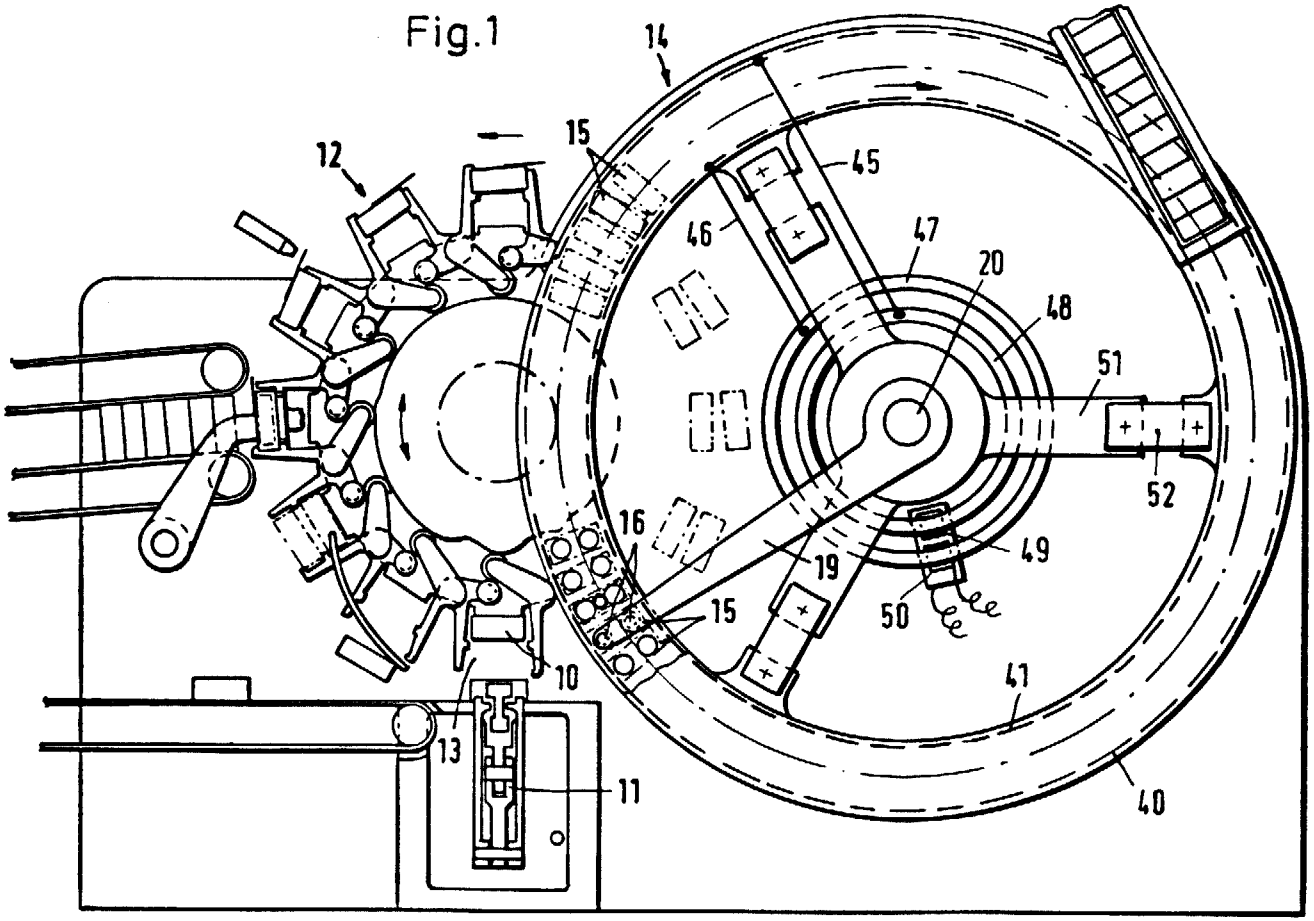
FIG. 1 is a diagrammatic side view of a part of a comprehensive packaging machine comprising a turret according to the invention.

In the section of a comprehensive packaging machine shown in FIG. 1 the individual cigarette packs 10 are supplied by a lifter 11, to an intermediate revolver 12. These elements are well known and need not be described in detail. The intermediate turret 12 is provided with openable and closeable compartments 13 and each is designed to hold two cigarette packs separated by the wall protrusions as shown. One cigarette pack 10 is fed into the inner zone of the compartments 13 by the lifter 11.

The intermediate turret 12 conveys the cigarette packs 10 to a turret 14 which comprises a plurality of radially arranged shaping chambers 15. When the inner region of a compartment 13 is in overlapping relationship with one of the shaping chambers 15 of the turret 14, the cigarette pack 10 is dislodged axially from the relevant compartment 13 and inserted in a shaping chamber 15.

The cigarette packs 10 remain in the shaping chambers 15 of the turret 14 with their, as yet, incompletely set or hardened glue spots, until these glue spots have hardened and thus until the shape of the cigarette pack has stabilized. In the present case the cigarette packs 10 remain in the respective shaping chambers 15 throughout virtually a complete rotation of the turret 14. When the respective chambers 15 are again in an overlapping relationship with an outer region of a compartment 13 of the intermediate turret 12, the cigarette packs 10 are removed from the chamber 15 in an axial direction and introduced into the respective compartment 13. This ejection operation is performed by a double push rod 16 shown in FIG. 4 comprising two heads 17 and 18, the latter penetrating the chambers 15 and ejecting the cigarette packs 10.

The double push rod 16 is mounted on an actuating arm 19 which is, in turn, displaceable by means of a connecting rod 20 mounted coaxially to the turret 14.

Figure 2:
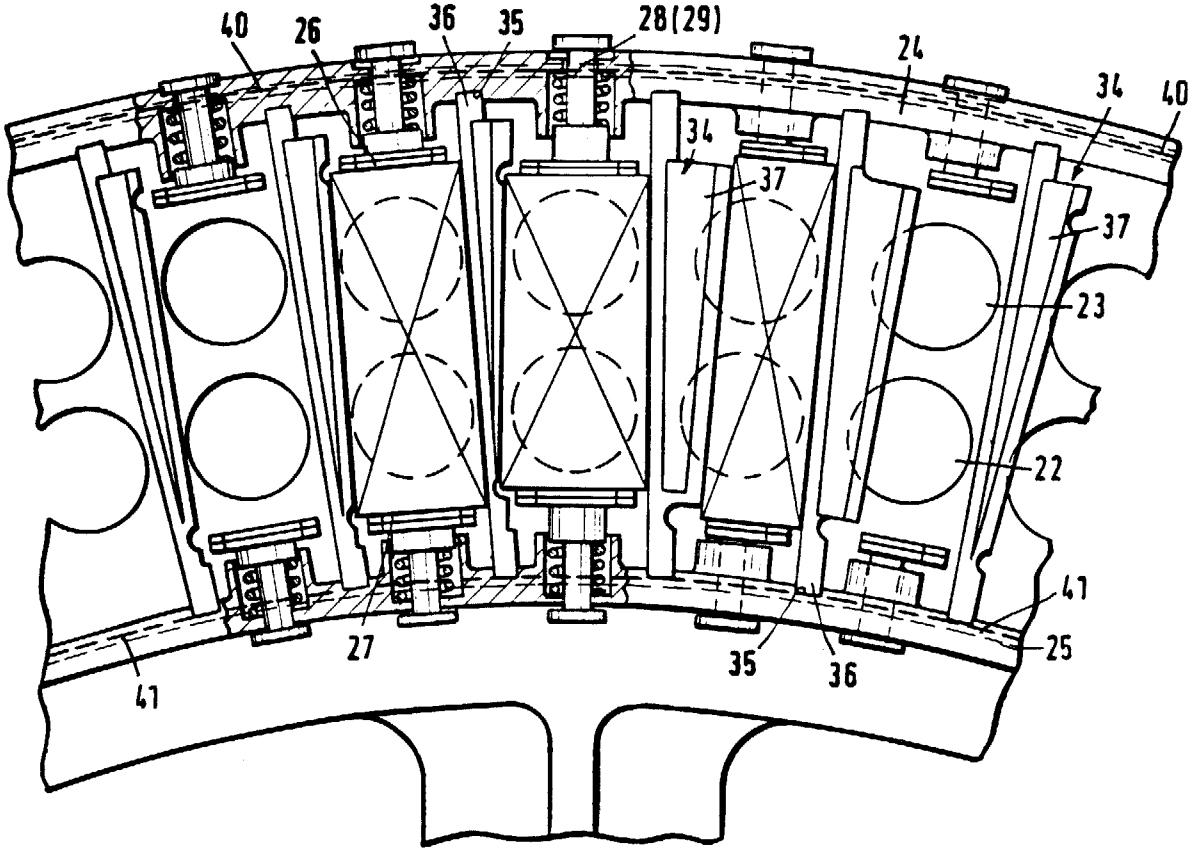
FIG. 2 is a side view, particularly, a partial sectional view on a enlarged scale of a section in the region of the periphery of the turret.
Figure 3:
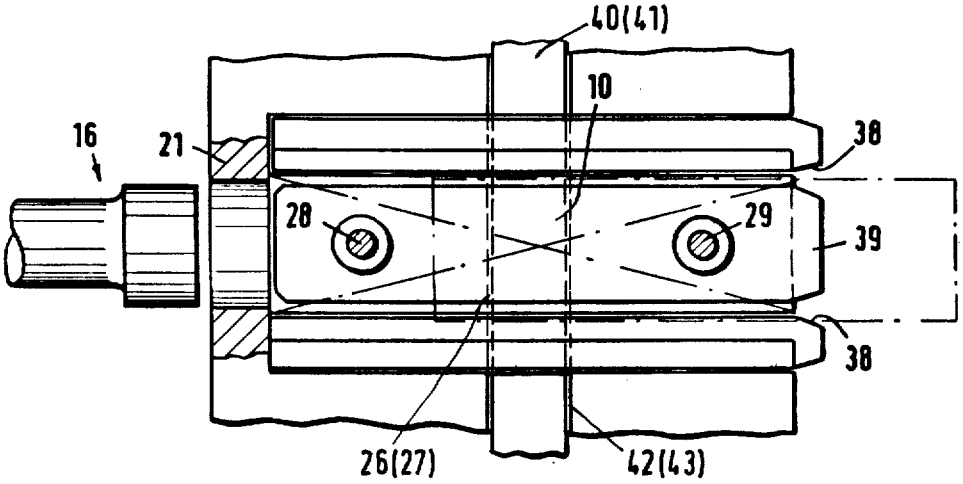
FIG. 3 is another enlarged scale view of a radial section in the region of an individual molding chamber.

The shaping chambers 15 have a special design as shown in FIG. 2. The walls of the chambers 15 are in contact with the pack in the region of the (larger) front faces, of the (narrower) side faces and in the region of an end face of the pack. The walls of the chamber 15 are disposed in a precise relative position with respect to one another such that the cigarette pack 10 adopts a precise oblong shape as a result of its position in relation to the walls of the chamber.

The individual chambers 15 consist of a rigid base 21 which is formed on the side of the shaping chamber 15 remote from the open insertion side thereof. The end of the cigarette pack 10 which is inserted first into the chamber 15 is disposed in contact with this base 21. The base 21 is provided with opening passages 22 and 23 for the heads 17 and 18 of the double push rod 16.

Rigid, radial inner and outer supporting walls 24 and 25 are integral with the base 21. These walls 24 and 25, together with the base 21, form part of the supporting frame of the turret 14. The actual shaping walls, namely the partitions 26 and 27, are mounted on the support walls 24 and 25. These side walls 26 and 27 made of plastic, for example, are in contact with the narrow side faces of the cigarette pack 10.

The side walls 26 and 27 are displaceably mounted. For this purpose two strikers 28 and 29 are applied on each side wall 26, 27. These penetrate with a support head 30 into a recess 31 of the supporting walls 24 or 25. A tension spring 32 is supported in the recess 31. The support head 30 of the striker 28 or 29 is in contact with the free end of the tension spring 32. The opposite free end of the striker 28, 29 projects from the recess 31 and is provided with a stop 33.

This arrangement, particularly, this technique of mounting the side walls 26 and 27 ensures an accurate parallel relative displacement for limiting the dimensions of the molding chamber according to differing pack sizes. The resilient mounting of the side walls ensures constant contact thereof with the lateral faces of the cigarette pack 10. The stop 33 shown in FIG. 4 defines the inner end position of the side walls 26 and 27. The supporting head 30 can also be provided with differing dimensions to adapt it to differing pack sizes (see FIG. 2).

The molding chambers 15 are limited in the circumferential direction of the turret 14 by rigid, radially directed front walls 34. These each limit two chambers 15 disposed in succession in the circumferential direction. The front walls 34 shape the two front faces (resp., front and rear faces) of the cigarette pack 10.

In the present embodiment, individual, separately produced front walls 34, which are preferably made of plastic, are interchangeably inserted in the turret 14. For this purpose, the supporting walls 24, 25 extending coaxially in the circumferental direction are provided with axially disposed grooves. The front walls 34 are inserted in these grooves in an axial direction by means of an appropriately formed extension 36.

In the immediate vicinity of the molding chambers 15, the front walls 34 are provided with wedge-shaped widenings 37. These are so designed that molding surfaces for limiting an oblong molding chamber 15 are formed on each side of a front wall 34. The dimensions, namely the thickness of these widenings 37 may vary according to the size of the cigarette packs to be processed (see FIG. 2).

The molding walls 26, 27 and 34, which define the molding chamber 15 and are in contact with the cigarette pack 10, are provided with bevels 38 or 39 on the edges facing toward the insertion side of the packs. These bevels facilitate insertion of the cigarette packs 10 in the shaping chambers 15.

The above-mentioned walls are also so designed and disposed that the corners and the edges of the cigarette packs 10 are, for the most part, not in direct contact with the walls of the molding chambers 15. As a result, any glue leakage in this zone does not come into contact with the walls of the chamber 15.

Figure 4:
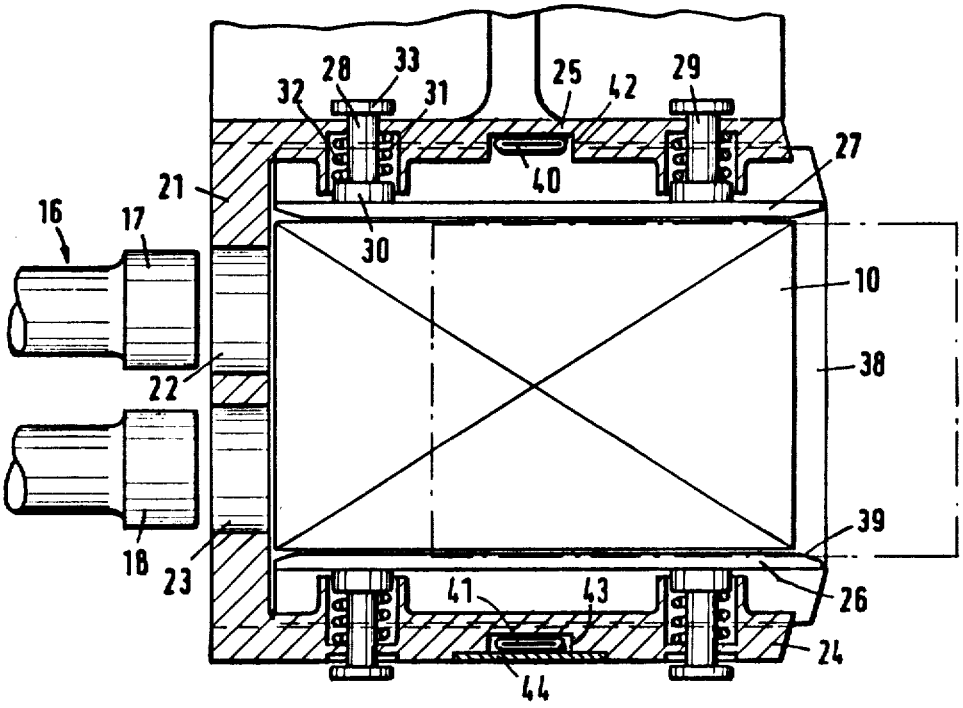
FIG. 4 is an axial section of a molding chamber according to FIG. 3.

Referring to FIGS. 1 and 4, the turret 14 is heated to a temperature in the range of approximately 50° to 60° C. by means of two annular heating elements 40 and 41. The heating elements are disposed in circumferential bands to heat each chamber 15. Each heating band is located in a groove 42, 43 placed approximately in the center middle of the inner and outer support partitions 24, 25. The outside heating band 41 is covered by an insulating covering 44. The heating elements are electrical strip heaters having leads 45 and 46 attached to slip rings 47 and 48. The slip rings rotate with the turret and electrical power transfer is via brushes 49, 50. Appropriate leads provide an input source of power to the brushes. Slip ring brush technology is well known and it is apparent that other electrical power transfer techniques can be employed.

The present invention achieves heating of the annular band of the turret in the area having the chambers 15 by defining a heating area within the heating elements 40, 41 and thermally isolating the ring of the turret having those chambers. Spokes 51 provide the necessary structural coupling and an insulating connecting element 52 is interposed between the annular ring and the spokes. Hence, the shaping chambers are thermally isolated from the remainder of the system. The turret 14 is heated to provide a localized region where the packages are structurally stabilized in a desired configuration and the glue will harden at an accelerated rate.

What is claimed is:

1. An apparatus for setting glued flaps, tabs or the like of rectangular hinged lid cigarette packs folded from cardboard blanks and for simultaneously maintaining a predetermined configuration of the packs during the setting of the glued portions, comprising:

(a) a rotatable turret (14) having a plurality of forming and setting chambers (15) disposed around its outer periphery, each of said chambers being dimensioned to receive a single cigarette pack (10) and to maintain a predetermined configuration of said pack, (b) each chamber being defined by:

(1) a floor member (21) lying opposite an open entry and exit end of said chamber and having apertures (22, 23) therein for accommodating push rods (16) for ejecting a pack after its glued portions have set, (2) inner and outer side walls (26, 27) lying opposite each other, and (3) two wedge-shaped, spaced, radially oriented partition walls (34), each rectangular pack thus being engaged over five of its six planar faces when inserted in a chamber, and (c) the chambers being so oriented in the turret that their longitudinal axes lie parallel to the turret axis and define a cylindrical surface of revolution concentrically surrounding the turret axis.

2. Apparatus according to claim 1, wherein the side walls of each chamber are spring biased inwardly against the narrow side surfaces of the cigarette pack.

3. Apparatus according to claim 2, wherein each side wall is mounted on two spaced, spring biased support rods (28, 29).

4. Apparatus according to claim 3, wherein the support rods are radially oriented, and are mounted in circumferential, concentric support walls (24, 25) of the turret.

5. Apparatus according to claim 2, wherein the inward movement of each side wall is limited by stop members.

6. Apparatus according to claim 1, wherein the partitions are removably mounted in the turret between circumferential, concentric support walls (24, 25) of the turret.

7. Apparatus according to claim 1, wherein the edges of each chamber adjacent its entry and exit end are chamfered.

8. Apparatus according to claim 1, wherein the chambers are electrically heated by circular heating element means.

9. Apparatus according to claim 8, wherein the circular heating element means comprises two band elements (40, 41), one mounted on the radially outward side of the chambers, and the other mounted on the radially inward side of the chambers.

10. Apparatus according to claim 9, wherein the radially outward portion of the turret including the chambers is thermally insulated from the remaining inward portion of the turret by thermally insulating connecting members (52) mounted to spokes (51) of the turret.

* * * * *